United States Patent [19]

Garnier

[11] 4,154,171

[45] May 15, 1979

[54] OVERHEAD CABLE TRANSPORT INSTALLATION

[75] Inventor: Marcel Garnier, Grenoble, France

[73] Assignee: Pomagalski S.A., Fontaine, France

[21] Appl. No.: 805,336

[22] Filed: Jun. 10, 1977

[51] Int. Cl.[2] ..... B61B 11/00; B61B 7/04; B61B 12/02

[52] U.S. Cl. ..... 104/182; 104/115; 104/173 ST; 254/190 R

[58] Field of Search ..... 104/173 ST, 182, 112, 104/115, 116; 254/137, 138, 175.3, 190 R, 192, 193

[56] References Cited

U.S. PATENT DOCUMENTS

| | | | |
|---|---|---|---|
| 1,928,117 | 9/1933 | Stewart | 254/138 |
| 3,128,722 | 4/1964 | Sowder | 104/115 |
| 3,585,940 | 6/1971 | Hancock | 104/173 ST |
| 3,861,651 | 1/1975 | Takamura | 254/175.5 |
| 4,042,216 | 8/1977 | Maraux | 254/138 |

FOREIGN PATENT DOCUMENTS

| | | | |
|---|---|---|---|
| 28127 | 2/1884 | Fed. Rep. of Germany | 104/182 |
| 53660 | 1/1890 | Fed. Rep. of Germany | 104/182 |
| 2215341 | 10/1975 | France. | |
| 2278548 | 2/1976 | France. | |
| 244753 | 5/1947 | Switzerland. | |

*Primary Examiner*—Albert J. Makay
*Assistant Examiner*—Randolph A. Reese
*Attorney, Agent, or Firm*—Stevens, Davis, Miller & Mosher

[57] ABSTRACT

The invention relates to a skilift or chairlift having cable supporting wheels arranged in the form of an inverted V to allow the passing of the grips between the wheels. The wheel has a lining shaped as a half pneumatic tire and made of a quasi inelastic wear resistant material.

3 Claims, 14 Drawing Figures

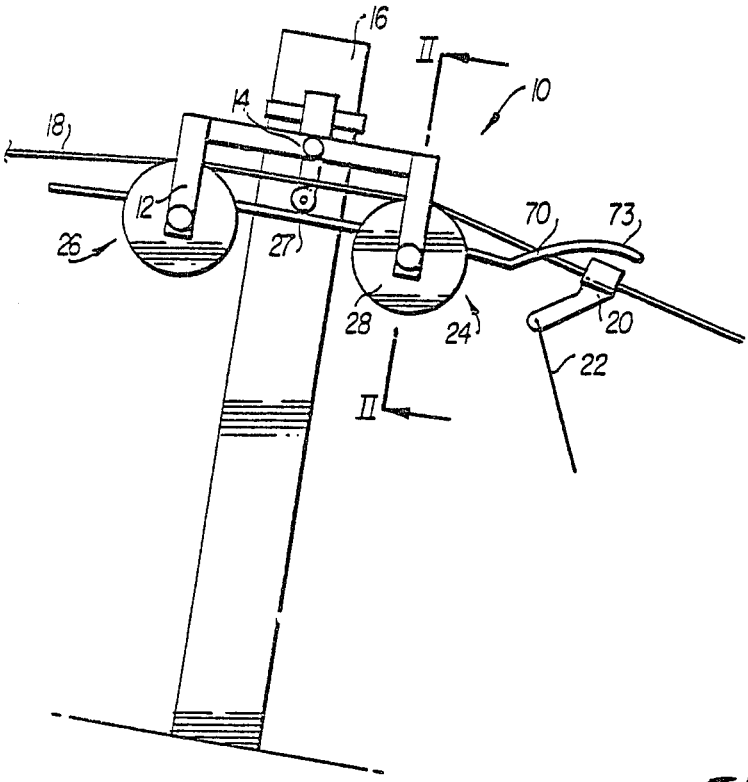
FIG. 1
FIG. 2
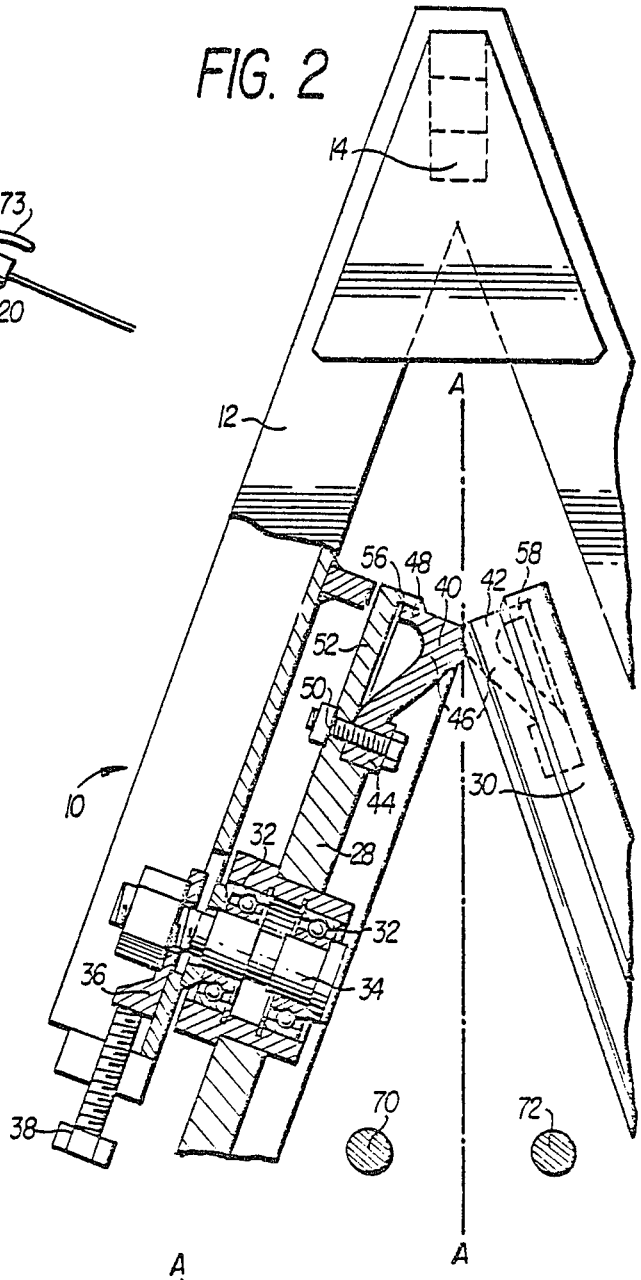
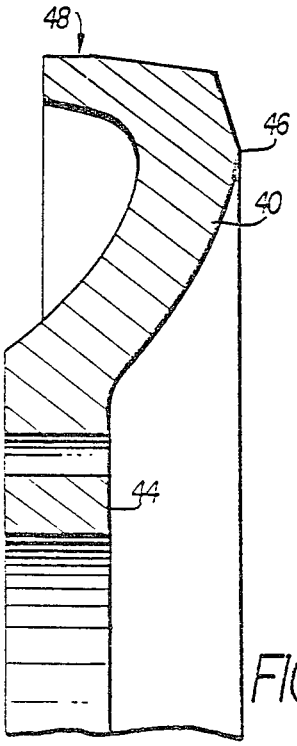
FIG. 3
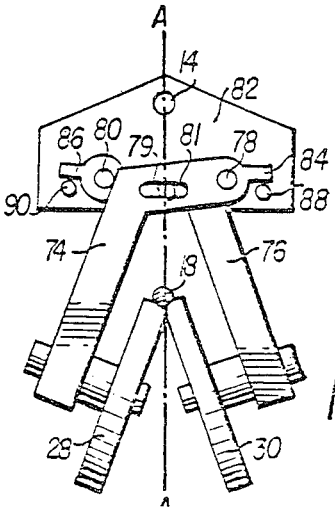
FIG. 7

FIG. 4
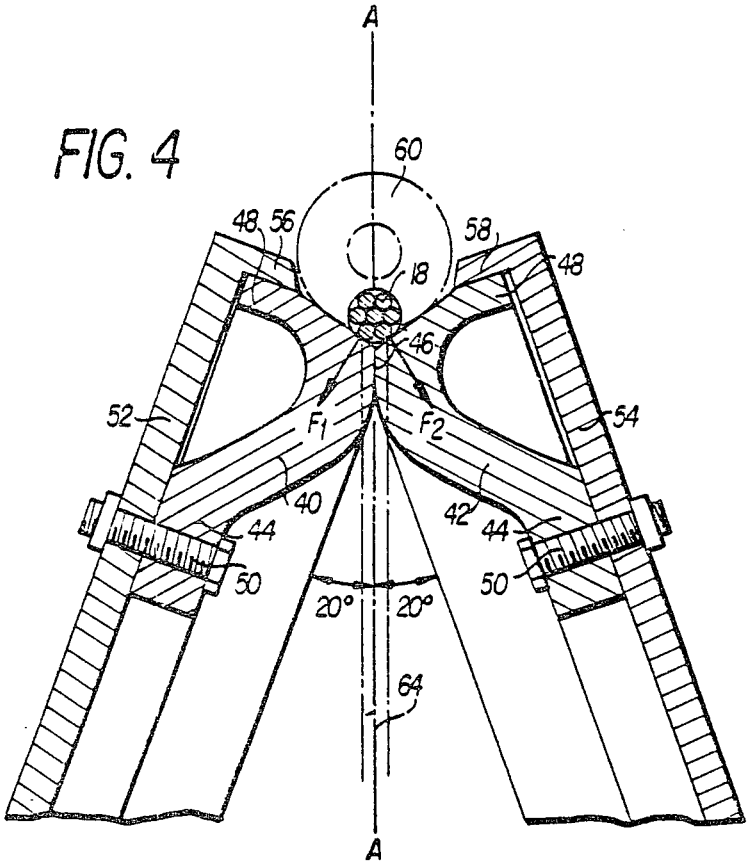
FIG. 5
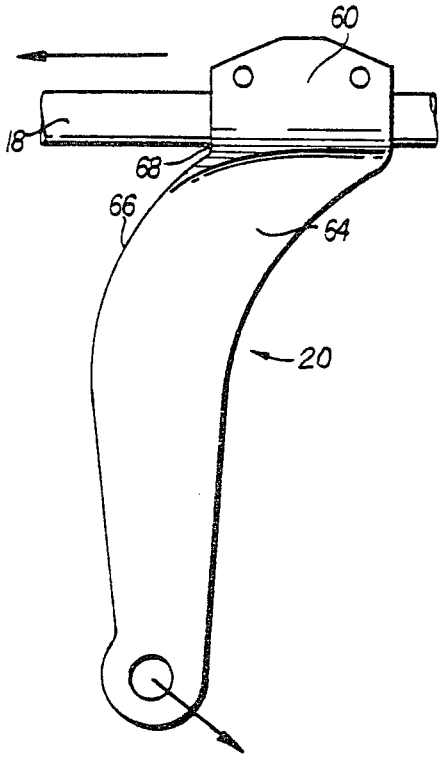
FIG. 6
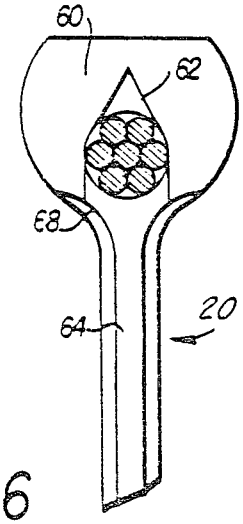
FIG. 8
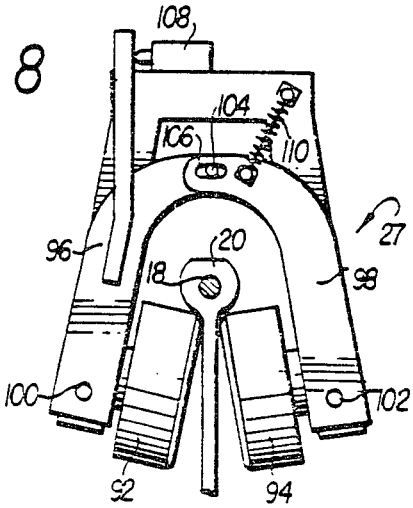
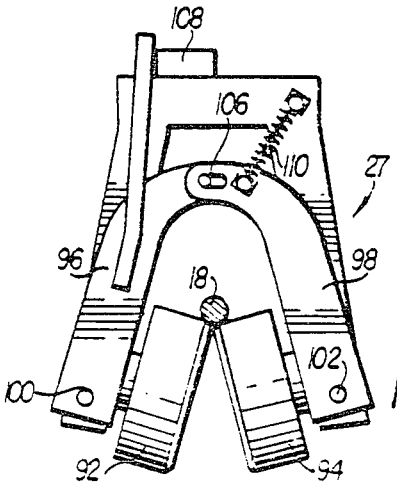
FIG. 9

OVERHEAD CABLE TRANSPORT INSTALLATION

The invention relates to an overhead transport installation with a cable to which is imparted a longitudinal movement for hauling loads coupled on to the cable by means of grips, in particular to a skilift or chairlift.

The Swiss Pat. No. 244,753 describes an installation of the type mentioned, in which the cable is supported by wheels arranged in the form of an inverted V to allow the passing of the grips between the said wheels. An opposed pair of wheels are so arranged as to form an angle of the order of 90° and the steel rims of the wheels are in punctual contact in the zone in which the cable is supported. In the theoretical case of a rectilinear cable, in punctual contact with the wheels, the cable runs without slipping and without wear, but it is easily understood that the curve in the cable, imposed by the support, implies a penetration of the curved part of the cable into the groove formed by the conjugated rims of the wheels and gives rise to considerable friction between the cable and the steel rims which is greater in the measure in which the angle formed by the wheels is larger. The rapid wear, due to the friction of metal on metal, limits the possibilities of the use of this arrangement to transporters of small loads with a practically rectilinear layout. It has already been proposed that the cable support wheels be provided with plastic linings, which adapt themselves by elastic distortion to the contour of the cable thus avoiding any metal to metal contact and facilitating the passing of the grips, but in the previously mentioned case of a pair of opposed wheels, the usual linings are forced together under the action of the cable, forming an obstruction and preventing the passing of the grips.

The known arrangements have redhibitory defects which explain their little success or practical use, in spite of their indeniable advantages in safety and simplicity and their conception tens of years ago.

The object of the present invention is to remedy the disadvantages mentioned above and to permit the realization of an installation the wear on the wheels of which is compatible with normal operational conditions and on which the free passing of the grips is ensured. Each wheel has a lining made of a quasi-inelastic wear-resistant material, the tread of which forming the said semi-support surface has a small thickness and a hollow convex profile to allow a distortion facilitating on the one hand the passing of the grips between the linings and on the other hand the pressing together of the linings of the two wheels under the compressive stress exerted by the cable supported by the two linings, the surface of contact between the two linings being limited.

By a suitable choice of material and the shape of the lining, the contact surface between the linings of the opposed wheels may be kept very small and be limited practically to an arc of a circle or more exactly an ellipse extending in the plane of symmetry of the assembly formed by the two wheels. The passing of a grip between the two wheels produces a distortion or a limited local compression of the linings, breaking locally the punctual contact which forms a negligable obstacle overcome without difficulty. A low dihedral angle, formed by the opposed wheels, increases the length of the arc of contact while limiting the distortion of the linings and allows the providing of an efficient support for the cable, while distributing the stresses. The component of these stresses, taken by the pressing together of the wheels, is also reduced by the said small angle, which facilitates the passing of the grips.

The distortion of the lining is advantageously limited to one direction by a cheek on the wheel, imparting, in the case of a continued effort, a distortion of the curved profile of the lining offering a high resistance. Any extraction of the cable from the wheels by force is thus excluded, and a preforming of the profile may be imposed for certain conditions of use.

At least one or for preference both the opposed wheels are mounted on a support with a limited pivoting or movement, permitting a slight separation of the wheels on the passing of a grip. The force holding the wheels in position may be provided by springs, but it is preferentially derived from the bearing force of the cable by a judicious arrangement of the support spindles.

A suitable material for making the lining is polyurethane, but materials with equivalent properties may of course be used.

The support device may be applied to any overhead cable installation and in particular to fixed-grip and detachable-grip skilifts. The support frame of the pair or successive pairs of wheels is so fixed to the tower as to pivot freely to ensure a self-alignment.

So as to direct the grips correctly to the wheels the support has guides arranged symmetrically and converging towards the entrance to the wheels. These guides may be extended in the form of a spiral centered on the cable, so as to bring down a grip accidentally released in front of a tower.

Other advantages and features will emerge from the following description of the various modes of application of the invention, given as non-limitative examples and shown in the annexed drawings, in which:

FIG. 1 is a schematic view in elevation of a support;

FIG. 2 is a partial view, on an enlarged scale, in a cross-section along line II—II of FIG. 1, showing the profile of the linings of a support on which there is no cable;

FIG. 3 is a view in cross-section showing the initial profile of a lining;

FIG. 4 is a view in cross-section, showing the active part of the support wheels and the profile of the inings supporting the cable, the position of a grip passing over the wheels being shown by a dotted line;

FIG. 5 is a view in elevation of a grip in accordance with FIG. 1;

FIG. 6 is a view from the left of FIG. 5;

FIG. 7 illustrates a variation in the design of the support;

FIGS. 8 and 9 show respectively the at rest and working positions of the cable-catching wheels;

Figure 10:
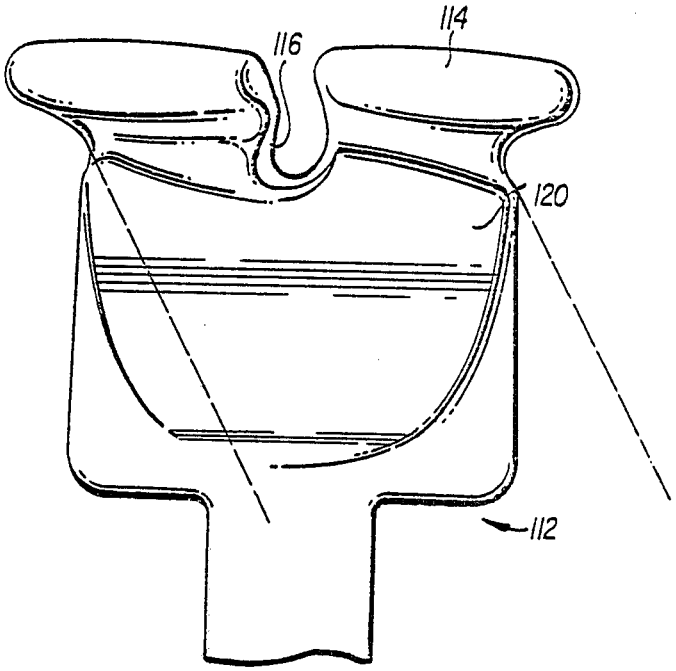
FIGS. 10, 11, 12 are respectively views in elevation from the side and from the rear of a fixed grip.

In the figures, a support device, designated by the general identification 10, has a frame 12, hooked on to or suspended from, for example by a spherical articulation 14, a portal or tower 16 of an overhead cable transport installation 18, in particular a skilift. Some grips 20, for example detachable, are coupled on to cable 18 and haul the skiers towbars 22.

Frame 12 is equipped with two pairs 24, 26 of wheels supporting cable 18, one of which will be described more particularly with reference to FIGS. 2 to 4, the other being identical and of a pair of cable catching wheels 27.

Wheels 28, 30 forming a pair 24 of support sheaves, are arranged symmetrically in relation to the vertical plane of support 10 of line A—A in FIGS. 2 and 4, slanting in planes forming angles of about 20° with plane A—A. Wheels 28, 30 are in contact, or practically in contact, in the manner described later, on their periphery, and thus form a dihedral or inverted V bisected by plane A—A, frame 12 being advantageously designed as a similar dihedron. Each of the wheels 28, 30 is mounted so as to rotate on ball-bearings 32 on a spindle 34, carried by a sliding support 36, with an adjusting screw 38, fixed to chassis 12. It will be understood that the screws 38 permit the movement of the wheels 28, 30 in the half-planes of the dihedral in the direction of the peak and to approach or separate the peripheries of the wheels 28, 30. Each of the wheels 28, 30 is equipped on its periphery with a lining 40, 42 the initial undistorted profile of which shown in FIG. 3, is analogous to that of a half pneumatic tyre, and has a centripetal fixing part in the form of an annular disc 44 and a convex lateral hollow intermediate part 46 connected with an external cylindrical band 48. The lining 40, 42 are fixed to the wheels 28, 30 by means of bolts 50 connecting the internal discs 44 to the hubs of the wheels. These hubs are both extended by a cheek 52, 54 with a curved periphery 56, 58 capping with a slight play the band 48 of lining 40, 42. The cheeks 52, 54 support in one direction the associated linings 40, 42 and limit the distortion of these. The linings 40, 42 are of small thickness in a material highly resistant to wear and quasi-inelastic or slightly elastic, for example in polyurethane. The shape and material of these linings are very important and condition the correct operation of this type of support.

In the mounted position of wheels 28, 30, the linings 40, 42 are in contact at their upper convex part 46 to form a bearing groove for cable 18. According to the characteristics of the installation, in particular the load and the layout, wheels 28, 30 may be slightly spaced or on the contrary pressed one against the other with a pre-distortion of linings 40, 42 accompanied by the thrusting of the bands 48 against the cheeks 52, 54. The convex shape of the linings limits the zone of contact which is appreciably punctual or following the arc of a circle or an ellipse when there is distortion.

FIG. 4 shows the pair of wheels 28, 30 supporting the cable 18 under tension, by the convex parts 46 projecting laterally from the wheels under the action of the bearing forces $F_1$, $F_2$, exerted by the cable 18 on the parts 46, these yield and buttress one another. The force pressing the linings one against the other thus depends on the force exerted by the cable and makes it possible to avoid any untimely escape of the cable imprisoned between wheels 28, 30 and the frame 12. The zones of contact between wheels 28, 30 on the one hand and between the wheels 28, 30 and the cable 18 on the other hand are limited thanks to the convex shape of the contact surfaces and to the rigidity of the material, which decreases the friction and the wear on these surfaces.

The grip 20, shown in FIGS. 5 and 6, with a button 60, well known in itself, fitted on cable 18 and with an inverted V profile 62 which is self-wedging under the towing force transmitted to lever 64 in the form of a thin blade. This thinness, in conjunction with the small contact surface between wheels 28, 30 facilitates the passing of the grips 20 between the wheels, the blade 64 being inserted of course between the linings 40, 42 in the manner shown by dotted line in FIG. 4. As the blade 64 passes, the material of linings 40, 42 is compressed locally without requiring any notable deflection of the convex part 46.

The lever 64 has a front part projecting beyond button 60, so as to come into contact with wheels 28, 30 before the button 60, and to be hauled and propelled by the wheels to the opposite side. Thus is avoided any risk of the detaching of button 60 at the entrance to wheels 28, 30, as it is obligatorily hauled by the associated lever 64 already engaged between the wheels. The lower front edge 68 of the button 60 is in addition chamfered to prevent lifting and thus detaching of the button 60.

The low tilt of wheels 28, 30, of about 20° makes it possible to provide for cable 18 a bearing groove appreciably comparable with the grooves of the usual sheaves, in which the cables follow the curve of the sheave moving at all contact points without slipping, that is to say, without wear. Also it may be observed that the low angle limits the buttressing forces between linings 40, 42 which would risk hindering the passage of grip-levers 64. The low angle necessitates on the contrary, the correct presentation of the grips 20, and according to the invention, the guides 70, 72, each formed by a bar fixed to frame 12, are arranged symmetrically in relation to plane A—A in front of support 10. The convergent parts are preceded by a spiral part 73 centred on cable 18 and with a radius smaller than the length of lever 64 so as to bring downwards the lever of a towhanger released inopportunely.

FIG. 7 illustrates a variation in design, in which the wheels 28, 30 are fixed on levers 74, 76 mounted so as to pivot on spindles 78, 80 of a frame 82 fixed to the tower by an articulation 14. A connection by means of a stud 79 and a slide 81 imposes the symmetrical pivoting of levers 74, 76 causing the separating or the approaching of wheels 28, 30, which in combination with the dispositions described above facilitates the passing of the grips 20 by the temporary separation of the wheels 28, 30. The separating pivoting is limited by the lugs 84, 86 on levers 74, 76, working in conjunction with stops 88, 90 on frame 82. The spindles 78, 80 on which pivot levers 74, 76 is fitted to the side of the plane of symmetry A—A opposite to the associated wheel, in such manner as to derive from the bearing force of cable 18 on the wheel a moment exerted on contact on wheels 28, 30.

The limited separation can evidently be obtained by an elastic mounting of the wheels or by any other system of movement.

The fixing of the lining may be different and this may be inflatable with air or with water.

On referring to FIGS. 8 and 9, there may be seen the pair 27 of catcher wheels 92, 94, each carried by a support 96, 98, mounted so to pivot to a limited degree on spindles 100, 102. The supports 96, 98 are connected by a link formed by stud 104 and slide 106 imposing limited symmetrical separations of wheels 92, 94 sufficient for the passing of grip 20, but smaller than the diameter of cable 18. A detector 108 signales the pivoting of supports 96, 98 and a spring 110 exerts a pressure on the supports in the separated position.

The wheels 92, 94 are in steel and are during normal working fitted below and separated from cable 18 so as not to come into contact with cable 18 or grips 20. Should cable 18 fall, following for example the breaking of a support wheel 28, 30, cable 18 is caught by wheels 92, 94, which under the effort pivot into the approached position shown by FIG. 9. The detector 188 signals the incident.

Figure 11:
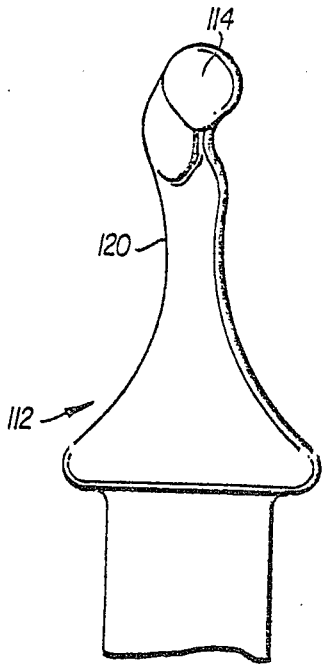
Figure 12:
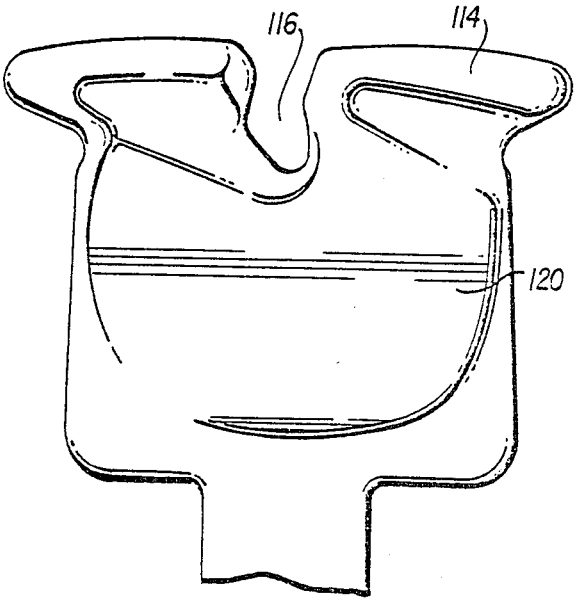
Figure 13:
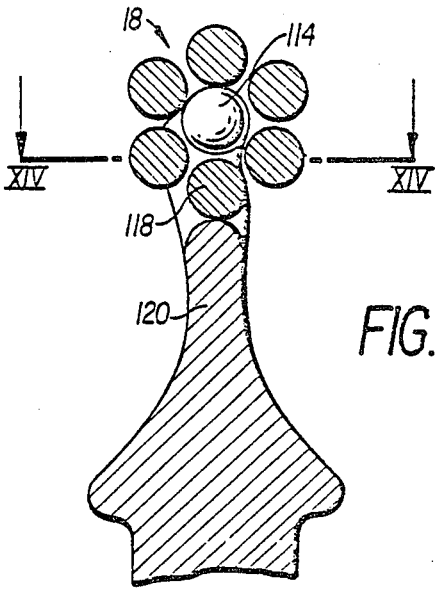
FIG. 13 is a view in cross-section along line XIII—XIII of FIG. 14, showing a grip fixed on the cable.
Figure 14:
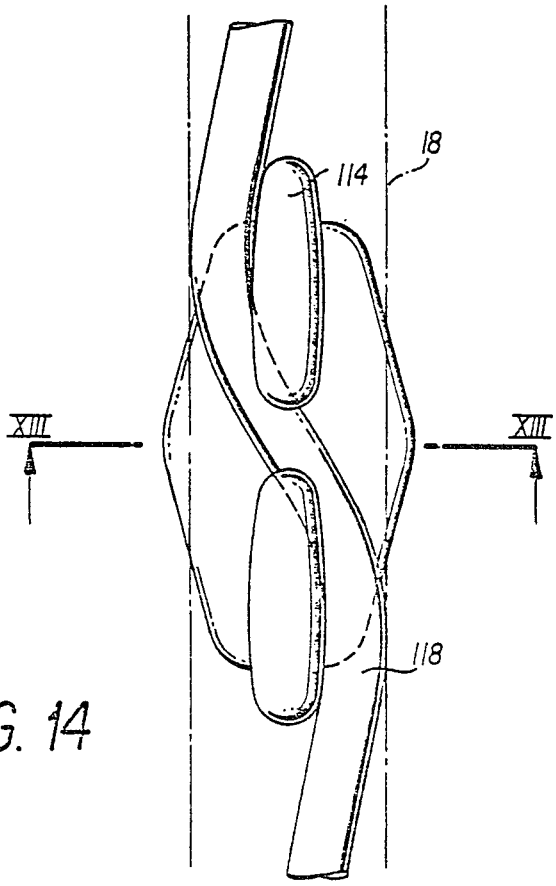
FIG. 14 is a view in cross-section along line XIV—XIV of FIG. 13.

The FIGS. 10 to 14 illustrate a fixed grip 112, known in itself, applied to an installation with supports of the above-mentioned type. The grip 112 has on the upper part a cylindrical rib 114 split at the middle 116 to allow the passing of a strand 118 of the cable 18 when the grip is in the fitted position. The rib is then housed in the core of the cable 18 and is tightly held by the strands without notably modifying the external section of the cable (see FIG. 13). The rib 114 is connected with a thinned part 120 extending below the cable in the vertical plane and able to pass in the manner described above between the support wheels 28, 30. Part 120 may be oblique in form in one direction, in the case of a skilift, as shown by a dotted line in FIG. 10, and corresponding with the direction of towing.

What is claimed is:

1. An overhead cable transport installation having grips coupling loads on to the cable, in particular, a skilift or chairlift, comprising a frame supporting the cable, at least one pair of rotating wheels carried by the said frame and arranged symmetrically below the cable in two dihedral planes with a peak located with respect to said cable in such manner as to present to the cable a supporting and guiding surface by the juxtaposition of two half-surfaces each belonging to one of the wheels, each wheel being equipped with linings in a quasi-inelastic wear-resistant synthetic material with a tread forming the said supporting half-surface, the said lining being thin with a convex hollow profile permitting a distortion facilitating on the one hand the passing of the grips between the linings and on the other hand the thrusting of the linings of the two wheels one against the other under the compressive stress exerted by the cable on the linings, the contact surface between the two linings being restricted, the said lining having a discoidal internal periphery for fixing to the wheel, and a curved external periphery forming a surface appreciably cylindrical and coaxial with the wheel, the said wheel having a thrust side-plate which acts in conjunction with the said external periphery to limit the axial movement of the said curved external periphery in the direction opposite to the convex profile of the lining.

2. An installation in accordance with claim 1, having for each of the said wheels a support lever and a spindle secured to said frame and articulating the said support lever parallel with the cable so that it can pivot in a plane perpendicular to the cable to allow a limited separation of the said wheels facilitating, in combination with the distortion of the linings, the passing of the grip, said spindles being laterally offset in relation to the cable in such manner that the bearing force of the cable on the wheels is exerted in such manner as to approach the said wheels, connection means between said support levers imposing the symmetrical pivoting of said support levers.

3. An installation in accordance with claim 1, with a stranded cable and fixed grips with a rib that can be housed between the strands of the cable and a thin shank on which is fixed the load, projecting below the cable in the vertical plan including said cable.

* * * * *